United States Patent [19]

Miller et al.

[11] Patent Number: 4,608,715

[45] Date of Patent: Sep. 2, 1986

[54] PROTECTIVE GARMENT HAVING VARIABLE VENTILATION ENTRY AND EXIT PANELS

[75] Inventors: Richard D. Miller, La Habra; John W. Wyckoff, Fullerton, both of Calif.

[73] Assignee: Fitch-Wyckoff International, Inc., Fullerton, Calif.

[21] Appl. No.: 764,859

[22] Filed: Aug. 12, 1985

[51] Int. Cl.[4] ..... A41B 9/100

[52] U.S. Cl. ..... 2/1; 2/87; 2/93; 2/108; 2/DIG. 1

[58] Field of Search ..... 2/87, 93, 94, 96, 115, 2/DIG. 1, 108

[56] References Cited

U.S. PATENT DOCUMENTS

| | | | |
|---|---|---|---|
| 308,244 | 11/1884 | Fishel | 2/115 |
| 1,360,390 | 11/1920 | Gilfillan | 2/79 |
| 2,010,434 | 8/1935 | Langrock | 2/93 |
| 2,073,711 | 3/1937 | Robinsohn | 2/126 |
| 2,079,980 | 5/1937 | Anders | 2/115 |
| 2,084,173 | 6/1937 | Wexler | 2/87 |
| 2,114,514 | 4/1938 | York | 2/93 |
| 2,259,560 | 10/1941 | Glidden | 154/2 |
| 2,700,769 | 2/1955 | Polchinski | 2/DIG. 1 |
| 2,713,168 | 7/1955 | Baenato | 2/DIG. 1 |
| 2,715,226 | 8/1955 | Weiner | 2/DIG. 1 |
| 2,989,754 | 6/1961 | Bukspan | 2/87 |
| 3,045,243 | 7/1962 | Lash et al. | 2/1 |
| 3,086,215 | 4/1963 | Di Paola | 2/DIG. 1 |
| 3,153,793 | 10/1964 | Lepore | 2/108 X |
| 3,213,465 | 10/1965 | Ludwikowski | 2/87 |
| 3,710,395 | 1/1973 | Spano et al. | 2/78 R |
| 3,761,962 | 10/1973 | Myers | 2/79 |
| 3,921,224 | 11/1975 | Ingram, III | 2/93 |
| 4,185,327 | 1/1980 | Markve | 2/2 |
| 4,408,356 | 10/1983 | Abrams | 2/87 |
| 4,513,451 | 4/1985 | Brown | 2/93 X |

FOREIGN PATENT DOCUMENTS

| | | | |
|---|---|---|---|
| 0034518 | 2/1980 | European Pat. Off. . | |
| 1029851 | 6/1953 | France | 2/108 |
| 1220511 | 1/1960 | France . | |

*Primary Examiner*—Louis K. Rimrodt

*Attorney, Agent, or Firm*—Gausewitz, Carr & Rothenberg

[57] ABSTRACT

A protective garment having a ventilation system having means for selectively varying the pass of ventilation air through the garment and the size of the openings of the ventilation entry and exit panels to provide proper ventilation and prevent billowing of the garment.

15 Claims, 10 Drawing Figures

FIG. 1.
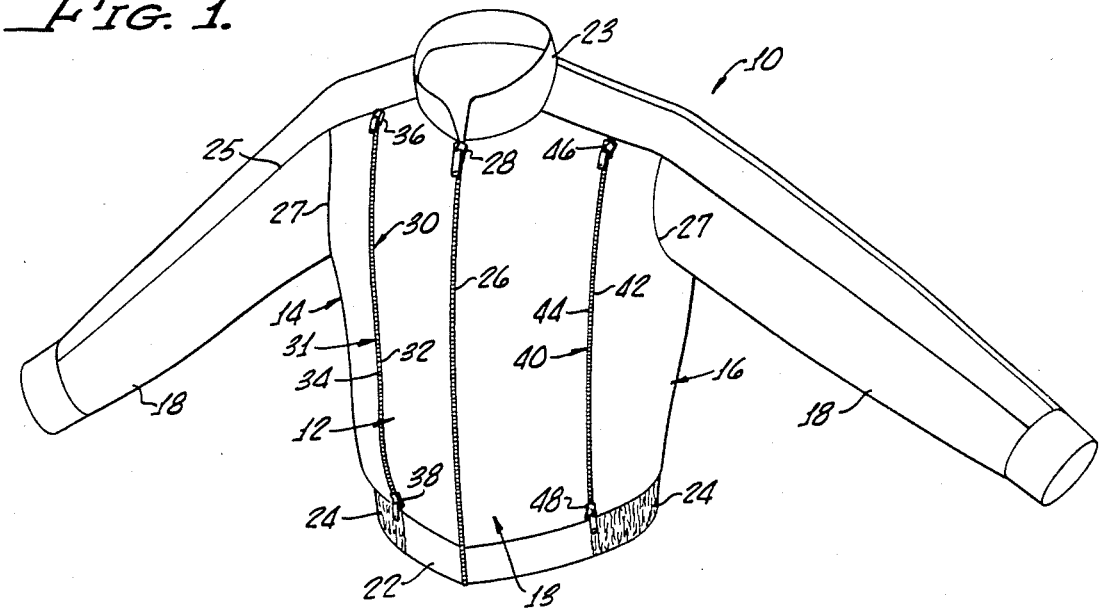
FIG. 2.
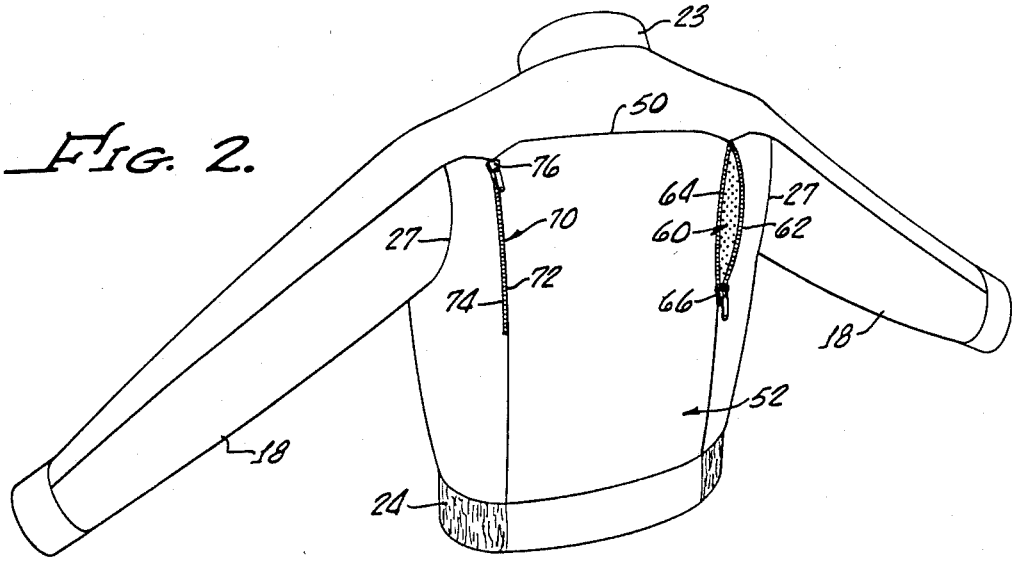
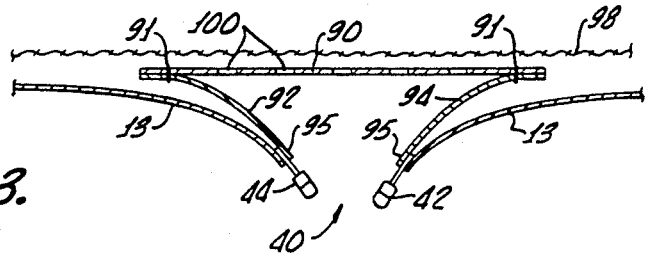
FIG. 3.

PROTECTIVE GARMENT HAVING VARIABLE VENTILATION ENTRY AND EXIT PANELS

FIELD OF THE INVENTION

The present invention relates to the field of protective garments covering the torso and upper body of the wearer, which due to the material from which the garment is made require the capability of ventilation of the garment, and which are particularly designed for use on bicycles, motorcycles or the like wherein the wearer is traveling at relative high speeds such that the garment ventilation system requires selectively varying the pass of the ventilation air through the garment and the size of the openings of the ventilation entry and exit panels to provide proper ventilation and further prevent billowing of the garment.

BACKGROUND AND SUMMARY OF THE INVENTION

It is known in the art to provide garments, including jackets and full body suits, with various forms of ventilation for the garment. One example of such garments provides for sections, patches or panels of air permeable material, for example, a mesh fabric, which may or may not be covered by panelling forming a portion of the garment. Examples of such garments are shown in the patents to York, U.S. Pat. No. 2,114,514, Gilfillan, U.S. Pat. No. 1,360,390, Fishel, U.S. Pat. No. 308,244, Bukspan, U.S. Pat. No. 2,989,754, Ludwikowski, U.S. Pat. No. 3,213,465, Spano, et al, U.S. Pat. No. 3,710,395 and Ingram, U.S. Pat. No. 3,921,224. Generally, the garments shown in the just-noted patents provide for entry and exit of ventilating air through ventilation openings either on the front or the back of the garment, and perhaps including also along the side or at the underarm of the garment, without providing for a creation of a ventilation flow through the garment from the front portion of the garment, around the body of the wearer in the interior of the garment, and out through the back of the garment. In addition, the just-noted patents provide for little or no control of the amount of the opening which serves the ventilating purpose thereby failing to control whatever limited amount of ventilation flow through the garment may be created by the ventilation openings in combination with the normal openings in the garment, for example, the neck and front fastening portion of the garment.

Another class of ventilated garments does employ some means of regulating the amount of the ventilation opening through the use of zippers or other fasteners which are selectively positionable to modify the size of the ventilation opening. Such garments are shown, for example, in the patents to Bagnato, U.S. Pat. No. 2,713,168, Di Paola, U.S. Pat. No. 3,086,215, Lepore, U.S. Pat. No. 3,153,793, Robinsohn, U.S. Pat. No. 2,073,711, Markve, U.S. Pat. No. 4,185,327, Weiner, U.S. Pat. No. 2,715,226. The just-noted patents, however, suffer from the drawback of having ventilation openings only on the front or the rear of the garment, or in the case of the patent of Weiner, on the front of the garment and along the in-seam of the sleeve. These garments also thus fail to provide for a flow path through the garment, even though the ventilation opening is regulated in size.

Another form of ventilated garment provides for a plurality of overlapping flaps which circle the garment, such as shown in the patents to Abrams, U.S. Pat. No. 4,408,356 and Glidden, U.S. Pat. No. 2,259,560. Such garments provide a relatively static form of ventilation, and are particularly unsuited for the purpose for which the garment of the present invention is designed. This is so for two reasons, first, the overlapping panels are not regulated in size, and remain continuously open with respect to the entry of air for ventilation through the openings covered by the overlapping panels. In addition, the overlapping panels on the front portion of the garment when the wearer is in a position such as on a motorcycle, would actually serve to inhibit the entry of air through the front portion of the garment thereby serving to negate airflow through the garment. At the same time, the airflow which does result from the entry of air into the ventilation openings covered by the overlapping panels on the front of the jacket would be unregulated and the back portion of the garment would tend to billow as a result of what airflow there is through the garment.

The patent to Myers, U.S. Pat. No. 3,761,962 shows a ventilated garment in which the front and rear of the garment are formed with a panel of air permeable material. Such a garment is also designed principally for a static form of ventilation. It does not provide for the regulation of the size of either the ventilation air entry opening or exit opening. Thus, the airflow through the interior of the garment is unregulated and further, it is basically through the central region of the garment, passing directly from the front panel around the body in the central region to the rear panel positioned also in the central region of the garment.

The patent to Lash, et al, U.S. Pat. No. 3,045,243 and the patent to Langrock, U.S. Pat. No. 2,010,434 show ventilated garments in which the amount of opening of the ventilation openings may be controlled by closure elements, for example, slide fasteners. Lash shows a jacket having two horizontal slits located approximately at the solar plexis of the wearer with the slits being closeable by a slide fasteners. The garment is also provided with a rigid curved spacer to bow out the opening in order to allow circulation of air up into the chest region of the garment. On the rear of the Lash, et al garment are two horizontal slits located approximately in the same torso position at the rear of the garment, and again having slide fasteners to control the exit slits. The Lash, et al garmet suffers from the limitation that for utilization in accordance with the use contemplated for the garment of the present invention, the wearer sitting in a hunched forward position, as on a motorcycle, would actually detract from the amount of ventilation airflow through the garment since the rigid-bowed portion of the ventilation openings on the front of the garment would shield the opening from receiving the full amount of the available air striking the front of the wearer of the garment and flowing around the garment. Only if the bowed portion of Lash, et al were modified to be on the bottom of the horizontal inlet openings, which is not suggested by Lash, et al, would the ventilation openings form a scoop to assist in the collection of the air flowing against the front of the wearer of the garment. Even in that event, the airflow would then tend to be downward toward the waist of the garment and would not adequately ventilate the chest region of the wearer or properly flow through the garment around the body of the wearer to the exit openings at the rear of the garment. Moreover, even such air as will flow through the garment in the Lash, et al ventilation system, the airflow would tend to be directly to the back openings aligned generally horizontally with the front openings, leaving the ventilation of the chest, shoulders and upper back inadequate. Langrock shows a jacket which is essentially designed for static ventilation, since the ventilation openings are constructed beneath overlapping pleats of the garment designed to conceal the openings. The patent of Langrock describes the ventilation openings as being formed due to body movement of the wearer. The design of Langrock is to shield the ventilation openings under the overlapping pleats to preserve the appearance of the garment. However, the overlapping nature of the pleats would tend to impede the entry of air into the front portion of the garment. Langrock does show slide fasteners on the inside of the garment where the pleats overlap in order to seal the openings when inclement weather so dictates.

The patent to Brown, U.S. Pat. No. 4,513,451 shows a ventilated garment in which a front flap on either side of the front garment opening is selectively positionable by two slide fasteners on either side of the flap to regulate the amount of air entering the front of the garment for ventilation purposes. At the rear of the garment shown in the Brown patent, a horizontal opening at generally just above the waistline in the rear of the garment serves as a ventilation air exit, along with a wedge of material from the collar down the center line of the back of the garment constructed of air permeable material. The Brown garment suffers from the drawbacks that the front flap can be an inconvenience if it comes loose from the tucked position shown in the patent while the wearer is riding on an open vehicle such as a motorcycle at relatively high speeds or if the wearer does not tuck the flap as shown in the Brown patent. In addition, the ventilation opening in the rear of the garment which serves to provide a path for ventilation air around the upper torso and out the back of the garment is not closeable, and thus may cause the wearer discomfort during inclement weather such as rain or cold weather. Further, the lower ventilation opening of the Brown garment has no means for selectively controlling the amount of airflow through that opening as it acts as a ventilation exit.

The patent of Robinsohn, U.S. Pat. No. 2,073,711 shows a jacket in which the underarm seam is formed with a ventilation opening having a closure means, for example, a zipper. Since the zipper shown in Robinsohn is a single-acting zipper, the ventilation system of Robinsohn must be fully opened in the front in order to have any ventilation opening in the back of the underarm. This limits the ability to regulate the amount of airflow through the underarm openings, and also tends to set up a flow pattern with the ventilation opening fully opened which deflects most of the air along the arm pit of the wearer and not into the garment, or alternatively with the front fully opened and the back partially open tends to greatly billow the garment in the sleeve and shoulder area.

The above-noted deficiencies in the prior art ventilated garments have been given by way of illustration to demonstrate that prior art ventilated garments have not been entirely satisfactory, particularly for use by a wearer on an open, high-speed vehicle, for example, a motorcycle. The necessity for such a wearer to use a garment made of heavy-duty material, for example, leather or synthetic leathers for body protection has in the past been insufficiently balanced against the need for a proper ventilation system to adequately provide comfort for the wearer during periods of warm temperature and/or heavy body exertion, for example, in riding a motorcycle cross country, while at the same time providing a system which will limit the amount of billowing of the garment while the rider is moving at relatively high speeds.

Recognizing the need for an improved ventilated garment, particularly for use in riding open air high-speed vehicles, for example, motorcycles and the like, it is the general object of the present invention to provide a ventilated garment having a torso ventilation system according to the present invention.

A feature of the present invention is to provide front and back verticle ventilation openings which are formed in the material of the garment and have cooperating closure members attached to the material of the garment, with a ventilation panel beneath the opening also connected to the closure members.

Another feature of the present invention is to provide closure members, at least on the front of the garment, which are selectively openable along the length of the ventilation opening so as to be able to open the ventilation opening fully, partially from the bottom thereof, partially from the top thereof, or partially from the top and bottom thereof, leaving a portion therebetween still closed.

A further feature of the present invention is to provide a ventilation panel which is connected to the closure members by a further strip of material attached to opposite sides of the ventilation panel and to a respective closure member to act as a scoop to increase the input airflow of ventilation air into the jacket.

Yet another feature of the present invention is to provide the pocket adjacent a portion of the ventilation panel, whereby the closure members for the ventilation panel acts as a closure member for the pocket as well.

Still a further feature of the present invention is to provide the ventilation panel constructed of a relatively heavy-duty material, for example, leather or synthetic leather, like the garment itself, provided with a plruality of perforations to make the ventilation panel strong and air permeable, and to provide a comfort lining in the jacket made of a mesh-like material which is knitted to form perforations and in addition is relatively more air permeable in the body of the material between the perforations than is the material of the ventilation panel.

Yet a still further feature of the present invention is to provide the front ventilation opening extending vertically on either side of the jacket opening from generally the shoulder fully down to the waist.

The above-noted features of the invention are given by way of illustration only and are not intended to be exhaustive, but rather are intended to assist those skilled in the art in better appreciating the invention disclosed in the detailed description of the preferred embodiments and the contribution thereof to the art. These and other features of the present invention will be better understood by reference to the detailed description of the preferred embodiment which follows in which reference is made to the following noted drawings, in the figures of which the use of like reference numerals is employed to identify like elements.

BRIEF DESCRIPTION OF THE DRAWING

FIG. 1 shows a perspective front view of a garment having a torso ventilation system according to the present invention.

Figure 4:
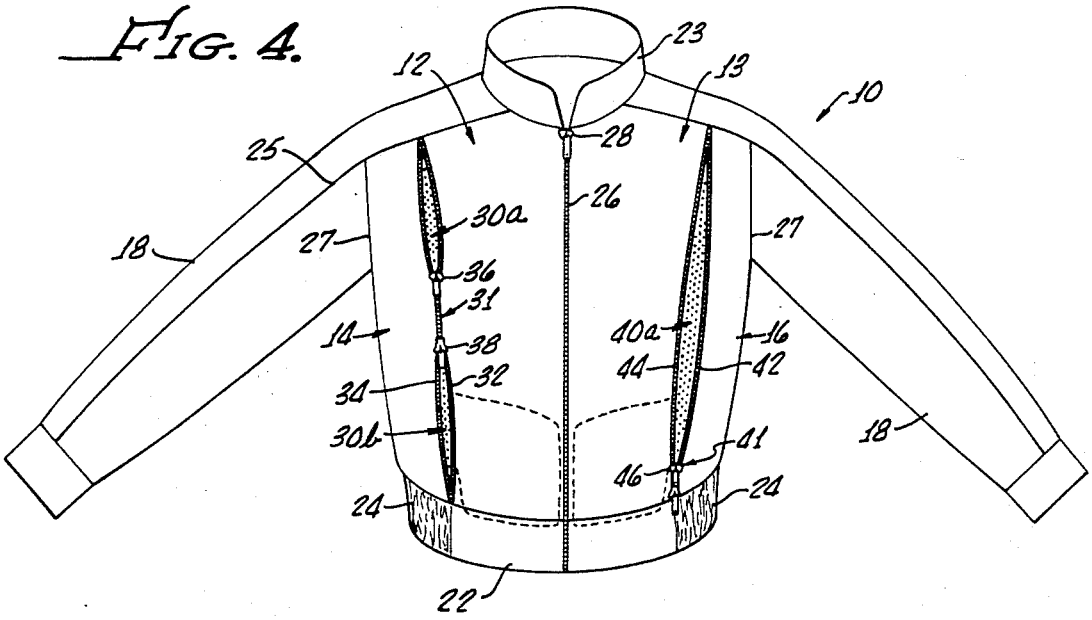

according to the construction of the present invention. The right ventilation opening 30 is divided into an upper portion 30*a* and a lower portion 30*b* by the positioning of the zipper slides 36 and 38 intermediate the ends of the zipper tracks 32 and 34 and spaced somewhat apart from each other along the zipper tracks 32, 34. Thus, a ventilation opening 30*a* is formed in the upper part of the jacket and a ventilation opening 30*b* is formed in the lower part of the jacket. It will be understood that according to the pertinent variables, for example, the amount of ventilation needed, the position of the wearer during the use of the jacket, for example, in riding a motorcycle, and the speed at which the wearer is moving, the size of the ventilation openings 30*a* and 30*b*, lengthwise, may be modified to obtain an airflow through the jacket with optimizes the comfort to the wearer with minimum billowing. This aspect of the invention can also be utilized to optimize the airflow paths through the jacket in order to optimize the flow of ventilation air over the various portions of the torso of the front and back of the wearer.

The left front ventilation opening 40 as shown in the fully opened position, with the zipper slides 46 and 48 both at the bottom of the zipper tracks 42 and 44. It will be understood that with both zipper slides 46 and 48 at the top of the zipper tracks 42 and 44, the ventilation opening 40 will also be fully open. It will also be understood, that with either the right ventilation opening 30 or the left ventilation opening 40, the respective zipper slides 36, 38 or 46, 48, could be placed with one zipper slide, 36, 38 or 46, 48 at its respective upper or lower end of the zipper tracks, 32, 34 or 42, 44 and with the other of the zipper slides 36, 38 or 46, 48 positioned away from its respective end of the zipper tracks, 32, 34 or 42, 44. In this manner, the ventilation opening can be positioned to be a single opening at either the upper portion of the torso on the respective side of the jacket 10 or the lower portion of the torso on the respective side of the jacket 10.

Figure 5:
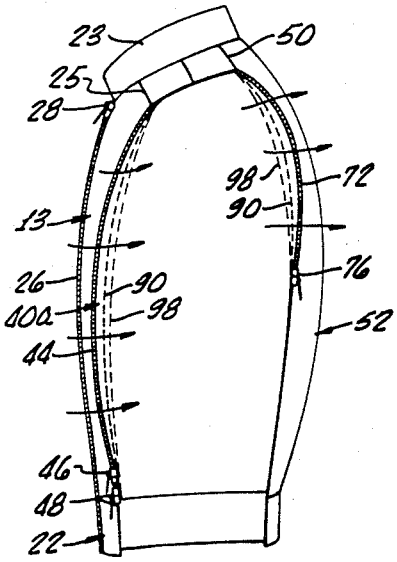

Turning now to FIG. 5, there is shown schematically an example of the airflow through the jacket of the embodiment shown in FIGS. 1, 2 and 3, with the left front ventilation opening 40 in the fully opened position. The air flows inwardly through the left ventilation front opening 40, around the sides of the torso and over the shoulder of the torso of the wearer and out through the left rear ventilation opening 70, also shown to be in the fully opened position.

Figure 6:
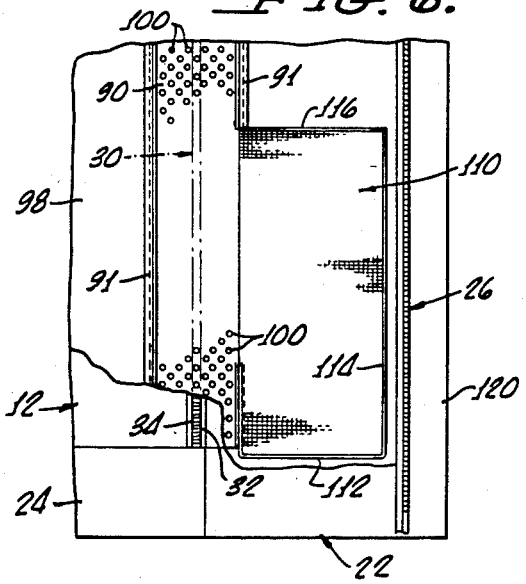

Turning now to FIG. 6, there is shown the positioning of the pockets, for example, the pocket 110 on the front left portion 12 of the jacket 10. The pocket 110, is formed by a cloth material such as cotton, dacron or other suitable fabrics which is stitched together along a seam 112 corresponding to the top of the waist band 22, intermediate the zipper tracks 32, 34 for the left ventilation opening 30 and the front closure 26 of the jacket 10. The material is also stitched together along a seam 114 adjacent the seam where the left front portion of the jacket 12, the jacket front closure 26 and a front closure flap 120 are stitched together. The pocket material is also stitched together along a seam 116, between the seam 114 and the seam 91 attached to the rightmost edge of the ventilation panel 90 as shown in FIG. 5. The material of the pocket is also stitched together along a seam 118 which is adjacent the seam 91 on the rightmost portion of the ventilation panel 90 as shown in FIG. 5 and at the lower end thereof, extending upwardly for approximately two inches. Beyond the end of the seam 118, the pocket material, forming an envelope or a pocket, 110 is stitched on one side of the envelope along the seam 91 to the ventilation panel 90, and on the other side of the envelope is stitched to the terminal end of the strip corresponding to the strip 92 shown in FIG. 3. Thus, the ventilation panel 90 and the strip, corresponding to the strip 92 shown in FIG. 3, are not stitched together along stitching seam 91 in the region where the opening for the pocket 110 is formed.

With the dual closure element structure according to the present invention, the ventilation opening 30 or 40 may be formed in the upper region of the jacket 10 and access to the pockets, for example, pocket 110 of the jacket 10 may be easily obtained through the use of the respective lower zipper slide, 38, 48 on a temporary basis, without modifying the position of the upper zipper slide 36, 46, defining the ventilation opening 30, 40 in the upper region of the respective side 12, 13 of the jacket 10.

Figure 7:
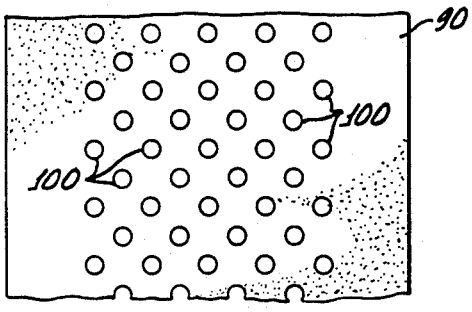

FIG. 7 shows a ventilation panel 90, which is made, as discussed above, of leather in the preferred embodiment, and has a plurality of holes 100 generally regularly spaced throughout the operative portion of the ventilation panel 90, which is exposed to airflow upon the opening of the respective ventilation opening, for example, right front ventilation opening 30 or left front ventilation opening 40. The holes are of a sufficient size to allow adequate airflow through the ventilation panel 90 when exposed to airflow, and preferably on the order of about one-eighth of an inch in diameter.

Figure 8:
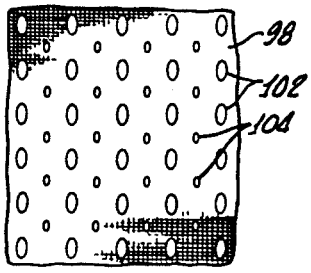

FIG. 8 shows the lining material 98, which is made, as mentioned above, of a taffeta material, woven into a net form having a plurality of larger openings 102 and smaller openings 104, arranged in alternating columns and also arranged in alternating rows. The size and displacement of the holes 102 and 104 in the lining material 98 are such as to not impede the passage of air entering through the ventilation panel 90 through the lining material 98, with the lining material itself being relatively more air permeable between the holes 102, 104 than is the material of the ventilation panel 90. The larger holes 102 are generally oval in shape having approximately a one-eighth inch major diameter and one-sixteenth of an inch minor diameter, with the smaller holes, also ovular, having approximately a one-sixteenth of an inch major diameter and one-thirtysecond of an inch minor diameter. The holes 102, 104 in the lining material 98 are spaced apart approximately seven-thirtyseconds of an inch on the diagonal, while the holes 100 in the ventilation panel 90 are spaced apart by approximately five-eighths of an inch on the diagonal.

Figure 9:
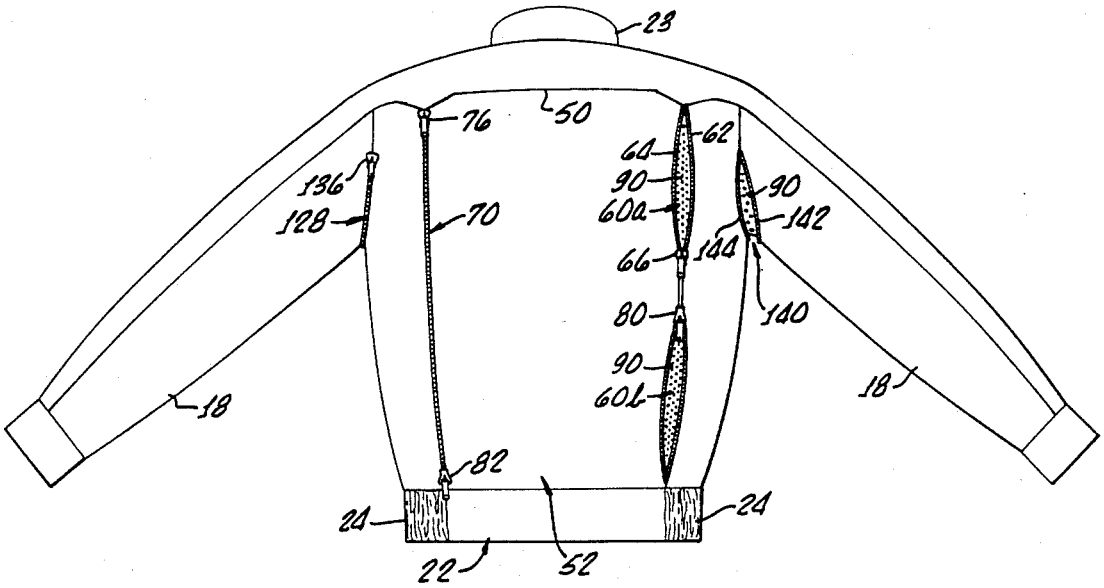
Figure 10:
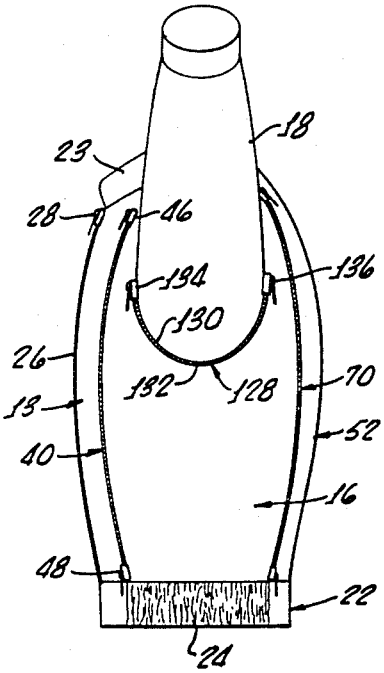

Turning now to FIGS. 9 and 10, there is shown an alternative embodiment of the jacket 10 having a torso ventilation system according to the present invention. FIG. 9 shows the back of the jacket 52 in which the rear right ventilation opening 60 and rear left ventilation opening 70 are formed by closures, for example, zipper tracks 62 and 64, as shown for the right rear ventilation opening 60, which extend from the rear shoulder seam 50 to the waist band 22. It will be understood, that with the dual closure system having, for example, dual zipper slides, 66 and 80 for the right rear ventilation opening 60 and 76 and 82 for the left rear ventilation opening 70, the versitility in selecting the size and location of the ventilation openings as discussed above, is equally available for the rear ventilation openings 60, 70. For example, as shown for the right rear ventilation opening 60, FIG. 2 shows a perspective back view of a garment having a torso ventilation system according to one embodiment of the present invention.

FIG. 3 shows a cross-sectional view of a ventilation opening and an underlying ventilation panel and liner of the jacket in accordance with a garment having a torso ventilation system according to the present invention.

FIG. 4 shown the manner in which the front ventilation or rear ventilation openings according to the present invention may be selectively positioned and selectively opened to variable degrees.

FIG. 5 shows a side view of the jacket according to the present invention with the sleeve cut away to illustrate the internal airflow of the ventilation air according to one embodiment of the present invention.

FIG. 6 shows a cutaway view of the jacket according to the present invention showing the attachment of a pocket to a portion of the ventilation panel such that the closure for the ventilation panel serves as a closrue for the pocket as well.

FIG. 7 shows a perforated ventilation panel according to the present invention.

FIG. 8 shows a portion of the jacket liner material according to the present invention.

FIG. 9 shows a back view of an alternative embodiment of the garment having a torso ventilation system according to the present invention, in which the exit ventilation openings run from the shoulder to the waist band and in which the jacket incorporates underarm ventilation openings.

FIG. 10 shows a side view of the jacket according to the second embodiment of the present invention with the sleeve raised to illustrate the positioning of the underarm ventilation opening and its dual-acting closure member.

DETAILED DESCRIPTION OF THE PREFERRED EMBODIMENTS

Turning now to FIG. 1 there is shown a front perspective view of the garment according to the present invention having a torso ventilation system. The garment of the present invention is shown in FIG. 1 in the form of a jacket 10, although it will be understood that the torso ventilation system according to the present ventilation may be employed with a jumpsuit-type full body garment and arranged in the portion of such a garment corresponding to the jacket 10 as shown in FIG. 1. In the view of the jacket 10 as shown in FIG. 1, there can be seen a right front portion 12 of the jacket 10 and a left front portion 13 of the jacket 10. The jacket 10 has a right side 14, and a left side 16. Sleeves 18 extend from the sides 14 and 16 respectively in the shoulder region of the jacket 10. The jacket 10 is provided with a waist band 22 which has elastic portions 24 at generally the sides of the waist band 22.

The right front portion 12 and left front portion 13 of the jacket 10 are joined together by a closure means, for example zipper 26, having a zipper slide 28. A right ventilation opening 30 extends vertically from the shoulder seam 25 at a point approximately midway between the point where the shoulder seam 25 crosses an underarm seam 27 and where the shoulder seam 25 joins a collar 27. The verticle right front ventilation opening 30 extends downwardly to a juncture with the waist band 22 at generally the point where the right side 14 elastic portion 24 joins the waist band 22. A similar left verticle front ventilation opening 40 is formed in the left front side 13 of the jacket 10. As shown in FIG. 1 the right front ventilation opening 30 and left front ventilation opening 40 are fully closed by closure members formed by zipper tracks 32, 34, for the right front ventilation opening 30 and 42, 44 for the left front ventilation opening 40 and an upward-facing zipper slide 36 and downward-facing zipper slide 38 for the right front ventilation opening 30 and a upward facing zipper slide 46 and a downward-facing zipper slide 48 for the left front ventilation opening 40. It will be seen, that with the zipper slide 36 at the upper most end of the zipper tracks 32, 34 and the zipper slide 38 at the lower most end of the zipper tracks 32, 34, the right front ventilation opening 30 is fully closed. Similarly, with the zipper slide 46 at the top and zipper slide 48 at the bottom of the zipper tracks 42, 44 the left front ventilation 40 is fully closed.

Turning now to FIG. 2, there is shown a rear perspective view of the jacket 10 according to the present invention. A rear shoulder seam 50 extends generally horizontally across the shoulderblades of the wearer of the jacket 10. Extending from approximately midway between the back center line of the jacket back 52 and the point where the rear shoulder seam 50 joins the left arm pit seam 27 is formed a vertically extending left rear ventilation exit opening 70, which extends to approximately midway between the rear shoulder seam 50 and the waist band 22. The left rear ventilation opening 70 is shown in the fully closed position being closed by a closure member, for example, a zipper having zipper tracks 72 and 74 with a zipper slide 76.

FIG. 2 also shows a right ventilation opening 60 formed by a closure member, for example, a zipper having zipper tracks 62 and 64 with a zipper slide 66. The zipper slide 66 is shown to be in the lowermost portion of the tracks 62, 64 when the right rear ventilation opening 60 is in the fully opened position. It will be understood that either or both of the left rear ventilation opening 70 and right rear ventilation opening 60 may be selectively placed in any of a plurality of positions from fully closed to fully opened, according to the position of the respective zipper slides 76 and 66.

Turning now to FIG. 3, there is shown a cross-sectional view of one of the ventilation openings in accordance with the present investion, and in particular ventilation opening 40 taken along lines 3—3 in FIG. 4. Lying below the ventilation opening 40 is a ventilation panel 90, formed of a durable, relatively heavy-weight material, for example, leather, having perforations 100 to allow for passage of air through the ventilation panel 90. The ventilation panel 90 is attached by stitching 91 to a respective one of the pair of ventilation opening strips, 92 and 94. The other longitudinal edge of the respective ventilation opening strip 92, 94 is attached by stitching 95 to a respective one of the ventilation opening zipper tracks 44, 42, at the same point where the zipper tracks, 44, 42 are attached to the edges of the left front portion 13 of the jacket 10, which edges define the position of the ventilation opening 40. Beneath the ventilation panel 90 is the jacket lining 98, made of a woven net of taffeta material, which is woven to form a plurality of holes in the material in the form of a netting, and which material itself is relatively more air permeable in between the holes of the netting of the material, than is the material of the ventilation panel 90.

Turning now to FIG. 4, there is shown a front view of the jacket 10 similar to that of the perspective view of FIG. 1, and which shows the versatility of the ventilation openings 30 and 40 on the front of the jacket 10 this opening is divided into an upper opening 60a and a lower opening 60b due to the positioning of the dual zipper slides 66 and 80.

Also shown in FIGS. 9 and 10 is an addition to the ventilation system previously described which forms a pair of ventilation openings in the underarm of the jacket. These ventilation openings 128 and 140 serve to add additional ventilation for the underarm of the wearer of the jacket 10 and also to some extent to ventilate down the sleeves 18 of the jacket. The ventilation openings 128, 140 are also formed with dual zippers, as will be seen more fully with reference to FIG. 10. FIG. 10 shows the left underarm ventilation opening 128 having a pair of zipper tracks 130 and 132 extending along the underarm seam 127 from approximately two inches below the front shoulder seam 25 to approximately two inches below the rear shoulder seam 50. The ventilation opening 128 is controlled by a pair of zipper slides 134 and 136. Shown in FIG. 9 is the ventilation opening 140 under the right arm pit of the jacket 10 in the fully opened position with its two zipper slides (not shown) in the front of the jacket 10. It will be appreciated, that like the front right and left ventilation openings, 30 and 40, and the rear right and left ventilation openings 60 and 70, the underarm ventilation openings 128 and 140 may be selectively opened at both ends of the respective zipper tracks, for example, zipper tracks 132 and 130 for the left underarm ventilation opening 128, while placing the zipper slides, for example, slides 134 and 136 for the left underarm ventilation opening 128 in a position intermediate the ends of the zipper tracks, for example, tracks 130 and 132. Thus the same ability to have openings at either end of the ventilation opening 128, or ventilation opening 140, with a portion of the center of the ventilation opening closed is possible with the underarm ventilation openings 128 and 140 as well.

SUMMARY OF THE SCOPE AND ADVANTAGES OF THE INVENTION

It will be seen from the above that the garment of the present invention provides several advantages over those ventilated garments existing in the art. Each of the ventilation openings in the front and back, and well as under the arms of the garment may be fully sealed by the closure members as necessary in inclement weather, for example, rain, when ventilation is either unnecessary or to have open the ventilation openings would cause more discomfort that the discomfort incurred by wearing the garment without ventilation. The garment is very suitable for bike riding, particularly motorcycle riding and allows for positioning of the front ventilation openings in one embodiment and both the front ventilation openings and rear ventilation openings in the other embodiment in a position to optimize the airfow through the garment by the utilization of the dual closure members for selectively positioning the size and location of the ventilation openings. Thus, for example, with the front ventilation openings, the openings can be positioned in the upper portion of the garment, or in the lower portion of the garment or in both the upper portion and lower portion of the garment with some intermediate portion being left unopened. The same is true for the back ventilation openings in the second embodiment. But even with the first embodiment, the back ventilation openings may be selectively opened in order to optimize the airflow through the garment while minimizing billowing. The ventilation openings in the preferred embodiment on the front of the jacket are formed with side panels which connect to a strong perforated ventilation panel to form an air scoop to further optimize the amount of air entering the ventilation opening in relation to the degree of opening of the ventilation opening. Another advantage of the present invention with the dual closure members is to allow for the positioning of the ventilation openings at the front of the garment in the upper region of the garment and to also allow for access to the pockets in the front of the garment without disturbing the ventilation openings in the upper region of the garment. In addition, the underarm openings, also with dual closure members allow for selectively positioning a ventilation opening at the front of the underarm and one at the rear of the underarm with the portion of the underarm intermediate these openings remaining closed. This allows for better optimization of the flow of the air through the garment in the region of the underarm and can be utilized to direct more of the ventilation flow up over the shoulder of the wearer of the garment between the front inlet and the rear exit opening so formed and also downwardly into the sleeves and across the front portion of the shoulder of the garment. In prior art arrangements with only one closure member, the airflow would tend to be more directly across the underarm itself from front to back, or if a portion of the back remains zippered closed, the increased ventilation within the jacket itself would also result in billowing of the jacket at the back region of the shoulder. The jacket of the present invention also has a comfortable air permeable liner which underlies the ventilation opening in both the front and back of the jacket.

The above-noted advantages of the invention are not intended to be exhaustive, but rather are illustrative of the advantages and scope of the present invention and improvement over the art provided by the present invention. These advantages are not intended to be exhaustive and those skilled in the art will appreciate that other similar features and advantages are evident from the disclosure of the present application. Moreover, the present application is not intended to be limited to the preferred embodiments shown herein. Rather, the preferred embodiments will be understood by those in the art to be subject to certain modifications which come within the appended claims. For example, the dual closure system for the ventilation openings, of the preferred embodiments, employing a zipper track with two opposing zipper slides, may be formed by other closure means, for example, "Velcro" fasteners. The garment itself is preferably made of leather, but may be made of other heavy-duty, relatively insulated materials, for example, synthetic leathers, vinyls, or even wool or other fiber material of sufficient bulk and tight weave to necessitate ventilation during wear in times of exertion or due to increased temperature. As mentioned above, the garment may also be a full length body suit type garment, having the ventilation system in the torso region of the garment corresponding to the jacket as shown in the present application.

These and other modifications of the present invention will be appreciated by those skilled in the art and the applicant intends by the appended claims to cover all such changes and modifications of the present invention has come within the scope and content of the appended claims.

What is claimed is:

1. A ventilated garment having a front of the garment, a back of the garment, with the front having a front left torso region and a front right torso region, each extending generally to a respective side region, forming a border between the front and the back of the garment, comprising:

a first vertically extending ventilation inlet opening formed in the front left torso region, generally at the verticle center of the left torso region, having an upper end and a lower end;

a second vertically extending ventilation inlet opening formed in the front right torso region, generally at the verticle center of the right torso region, having an upper end and a lower end;

each of the first and second ventilation inlet openings being formed by a ventilation panel, comprising a perforated material extending the length of the opening, a closure means having a first closure member attached to one side of the ventilation inlet opening and a second closure member attached to the other side of the ventilation opening, with the ventilation panel attached to the first closure member and to the second closure member in a manner to define the size of the ventilation opening when the first and second closure members are separated from each other over the ventilation panel;

first and a second rear ventilation outlet openings each disposed on opposite sides of the verticle center of the back of the garment and extending vertically on the back of the garment, each of the first and second rear ventilation outlet openings being formed by a panel of perforated material extending the length of the opening, a first closure member attached to one side of the ventilation outlet opening and a second closure member attached to the other side of the ventilation outlet opening, with the ventilation panel attached to the first closure member and to the second closure member in a manner to define the size of the ventilation opening when the first and second closure members are separated from each other over the ventilation panel.

2. The garment of claim 1 further comprising each of the ventilation panels being connected to its respective first closure member by a first strip of material and to its second closure member by a second strip of material.

3. The garment of claim 2 wherein the garment is lined substantially throughout the entire front and back with a meshed material underlying the respective ventilation panels.

4. The garment of claim 3, further comprising:

the closure members on at least the ventilation inlet openings being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventilation panel extending from both the upper and lower ends thereof but being joined intermediate the upper and lower openings thereby formed.

5. The garment of claim 3, further comprising:

each of the closure members being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventilation panel extending from both the upper and lower ends thereof but being joined intermediate the upper and lower openings thereby formed.

6. The garment of claim 2, further comprising:

the closure members on at least the ventilation inlet openings being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventila tion panel extending from both the upper and lower ends thereof but being joined intermediate the upper and lower openings thereby formed.

7. The garment of claim 3, further comprising:

each of the closure members being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventilation panel extending from both the upper and lower ends thereof but being joined intermediate the upper and lower openings thereby formed.

8. The garment of claim 1 wherein the garment is lined substantially throughout the entire front and back with a meshed material underlying the respective ventilation panels.

9. The garment of claim 8, further comprising:

the closure members on at least the ventilation inlet openings being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventilation panel extending from both the upper and lower ends thereof but being joined intermediate the upper and lower openings thereby formed.

10. The garment of claim 8, further comprising:

each of the closure members being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventilation panel extending from both the upper and lower ends thereof but being joined intermediate the upper and lower openings thereby formed.

11. The garment of claim 1 further comprising:

the closure members on at least the ventilation inlet openings being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventilation panel extending from both the upper and lower ends thereof but being joined intermediate the upper and lower openings thereby formed.

12. The garment of claim 11 further comprising:

the garment having a waist band region and a front and a rear shoulder region, the ventilation inlet openings extending from substantially the waist band region to the front shoulder region of the garment.

13. The garment of claim 1, further comprising:

each of the closure members being zippers having dual oppositely tracking closure operating mechanisms to allow the closure members to be selectively separated from each other over essentially the entire length of the ventilation panel, over a portion of the ventilation panel extending from the upper end thereof, over a portion of the ventilation panel extending from the lower end thereof, or over portions of the ventilation panel extending from both the upper and lower ends thereof but being joined intermediate the upper and lower openings thereby formed.

14. The garment of claim 13 further comprising:

the garment having a waist band region and a front and a rear shoulder region;

the ventilation inlet and outlet openings extending from substantially the waist band region to the front shoulder region of the garment.

15. A ventilated garment having a front of the garment, a back of the garment, with the front having a front left torso region and a front right torso region, each extending generally to a respective side region, forming a border between the front and the back of the garment, comprising:

a first vertically extending ventilation inlet opening formed in the front left torso region, generally at the verticle center of the left torso region, having an upper end and a lower end;

a second vertically extending ventilation inlet opening formed in the front right torso region, generally at the verticle center of the right torso region, having an upper end and a lower end;

each of the first and second ventilation inlet openings being formed by a ventilation panel, comprising a perforated material extending the length of the opening, a closure means having a first closure member attached to one side of the ventilation inlet opening and a second closure member attached to the other side of the ventilation opening, with the ventilation panel attached to the first closure member and to the second closure member in a manner to define the size of the ventilation opening when the first and second closure members are separated from each other over the ventilation panel;

means for selectively connecting the first and second closure members for the respective inlet opening over the entire inlet opening, over a length extending from the lower end thereof to a selected point intermediate the upper and lower ends, over a length extending from the upper end thereof to a selected point intermediate the upper and lower ends, or over a length extending from a first selected point intermediate the upper and lower ends to a second selected point intermediate the upper and lower ends;

first and second rear ventilation outlet openings each disposed on opposite sides of the verticle center of the back of the garment and extending vertically on the back of the garment, each of the first and second rear ventilation outlet openings being formed by a panel of perforated material extending the length of the opening, a first closure member attached to one side of the ventilation outlet opening and a second closure member attached to the other side of the ventilation outlet opening, with the ventilation panel attached to the first closure member and to the second closure member in a manner to define the size of the ventilation opening when the first and second closure members are separated from each other over the ventilation panel.

* * * * *

UNITED STATES PATENT AND TRADEMARK OFFICE

CERTIFICATE OF CORRECTION

PATENT NO. : 4,608,715

DATED : Sept. 2, 1986

INVENTOR(S) : Richard D. Miller et al.

It is certified that error appears in the above-identified patent and that said Letters Patent is hereby corrected as shown below:

On the title page:

The name of the co-inventor, John W. Wyckoff, is changed to ---John D. Wyckoff---.

Column 4, line 15, "verticle" should read ---vertical---.

Column 5, line 63, "verticle" should read ---vertical---.

Column 5, line 67, "verticle" should read ---vertical---.

Column 11, line 9, "verticle" should read ---vertical---.

Column 11, line 13, "verticle" should read ---vertical---.

Column 11, line 28, "verticle" should read ---vertical---.

Column 13, line 43, "verticle" should read ---vertical---.

Column 14, line 3, "verticle" should read ---vertical---.

Column 14, line 29, "verticle" should read ---vertical---.

Signed and Sealed this

Eighteenth Day of November, 1986

*Attest:*

DONALD J. QUIGG

*Attesting Officer* *Commissioner of Patents and Trademarks*